US005078394A

United States Patent [19]

Kretz

[11] Patent Number: 5,078,394

[45] Date of Patent: Jan. 7, 1992

[54] GOLF PUTTING IMPROVEMENT DEVICE

[75] Inventor: Paul O. Kretz, 7904 Tilby Rd., North Royalton, Ohio 44133

[73] Assignee: Paul Kretz, North Royalton, Ohio

[21] Appl. No.: 646,173

[22] Filed: Jan. 28, 1991

[51] Int. Cl.[5] ..... A63B 69/36

[52] U.S. Cl. ..... 273/34 B; 273/178 R

[58] Field of Search ..... 273/34 B, 180, 34 R, 273/178 R, 176 H, 195 A, 177 R

[56] References Cited

U.S. PATENT DOCUMENTS

| | | | |
|---|---|---|---|
| 1,612,291 | 12/1926 | Jackson | 273/34 B |
| 3,464,704 | 9/1969 | Nelson | 273/176 |
| 3,870,301 | 3/1975 | Brisendine | 273/34 B |
| 3,885,795 | 5/1975 | Brewer | 273/176 |
| 4,280,698 | 7/1981 | Troiano | 273/34 B |
| 4,900,023 | 2/1990 | Gelina | 273/34 B |

*Primary Examiner*—George J. Marlo

[57] ABSTRACT

A device placable on top of a conventional putting hole on a golf course contains a small opening in the center appropriately sized for a golf ball to pass through plus the top side of the device having a simulated putting green grass which matches the surrounding grass around the golf course putting hole. The golf putting device contains a special lip design which extends outwardly from the device perimeter and upon being inserted in the conventional golf course putting hole rests on the adjacent grass on the putting green thereby setting the device at the proper level relative to surrounding putting green. The golf putting improvement device is of such a design as to provide easy installation and removal without damaging the conventional putting hole.

2 Claims, 1 Drawing Sheet

GOLF PUTTING IMPROVEMENT DEVICE

BACKGROUND OF THE INVENTION

This invention relates to the game of golf especially in the area of improving ones ability to putt.

BACKGROUND—DESCRIPTION OF PRIOR ART

Both amateur and professional golfers are forever trying to improve their golf game skills in lowering their overall number of golf swings. One specific area golfers are continually trying to improve is putting. A method to improve ones putting proficiency is to utilize a golf cup insert which decreases the effective opening of a conventional golf cup, forcing the golfer to increase his/her concentration on the smaller area and thereby improving ones skill and confidence in putting.

Heretofore a wide variety of golf devices have been proposed and implemented for improving ones putting game. Such devices are shown in U.S. Pat. No. 4,280,698 issued July 28, 1981 and U.S. Pat. No. 4,900,023 issued Feb. 13, 1990.

The first referenced device consisted of a simulated grass attached to an expansion ring consisting of many angular bent teeth. These angular teeth will secure the putting aid device to the sides of a conventional golf putting hole. This device is difficult to insert into a conventional putting hole and align the device to obtain a true level relative to the surrounding grass. In addition, if the person installing and withdrawing this device is not careful, he can scratch and damage the sides of the golf cup with the angular bent teeth.

The other type of putting aid comprises of two cylindrical members of which the inside diameter of the first outer cylindrical member readily mates with the outside diameter of the second inner cylindrical member. The cylindrical members appear to be fabricated from a sponge rubber material which can be inserted into a conventional golf cup putting hole. Although this method is less damaging to the conventional golf cup side walls, it is much tricker for the golfer to insert into the hole and position it level with the surrounding grass. If the device is positioned to high, the golf ball will bounce away from the hole and conversely, if the insert is position to low it will allow the golf ball to readily fall into the hole providing the golfer with a false sense of confidence. Other problem with this device, is many of the conventional golf cups are position at various depths relative to the ground. Therefore, depending upon the golf cup depth, the cylindrical members may collapse on the inside cylindrical hole due to the fact of the outside cylindrical member slipping over the wall of the conventional golf cup. As a result, the collapse inner cylindrical member may suspend the golf ball thereby making it difficult to make multiple practice putting due to a jammed golf ball.

Therefore, most users would find it desirable to have a golf putting aid device which is readily insertable and removable, does not damage the golf course putting holes, plus obtains a true level relative to the adjacent putting green.

SUMMARY OF THE INVENTION

Objects and Advantages

According we claim the following as our objects and advantages of the invention: to provide a tool for easily, reliably and neatly insertable to a conventional golf course putting hole regardless of the depth of the cup or height of the grass without damaging the side wall of the putting hole. This device requires the minimum skill and training to install.

In addition we claim the following objects and advantages; to provide a device which will improve the golfer putting game by having him/her aiming at a much smaller hole. The device is designed to make the golfer not only aim the golf ball in a more precise angle but improve in tapping the ball to obtain the correct distance as well. Our device can be manufactured to either blend in with the natural surrounding golf green for the advance and the pro golfers or can be made with different colors, logos and markings for fun and relaxation. The concentric hole in the device can be made with various size hole diameters to accommodate different golfer skill levels.

Readers will find further objects and advantages of this invention from a consideration of ensuing description and accompanying drawings.

BRIEF DESCRIPTION OF THE DRAWINGS

Drawing Figures

Drawing Reference Numerals

Figure 1:
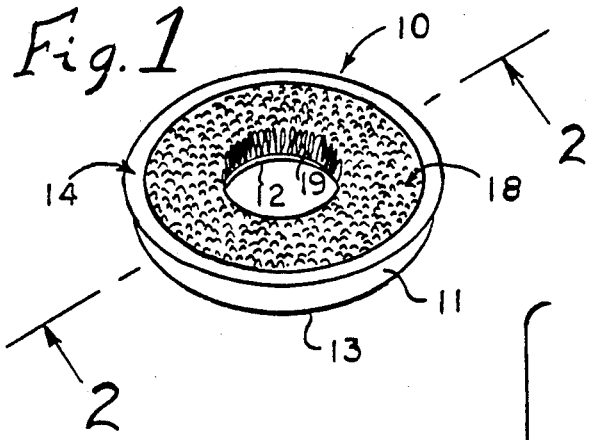
FIG. 1 shows a perspective back elevated view of the putting improvement device according to the invention.

10: retainer
11: retainer side wall
12: hole in retainer 10
13: retainer base plate
14: retainer rim lip
15: retainer recess area
18: putting green carpet
19: hole in carpet
30: conventional putting hole cup
32: ground
34: golf course grass
36: conventional golf ball

DESCRIPTION OF THE PREFERRED EMBODIMENT

Figure 2:
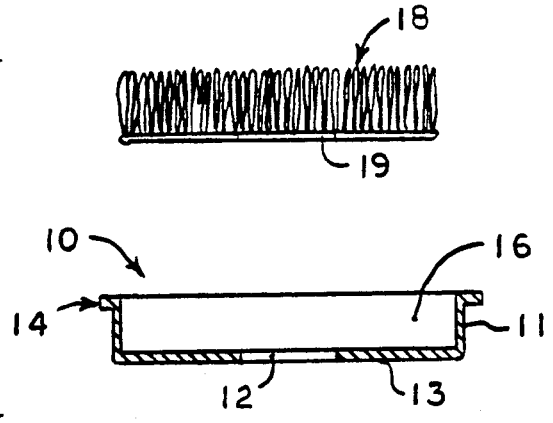
FIG. 2 shows a sectional view of the device in FIG. 1
Figure 3:
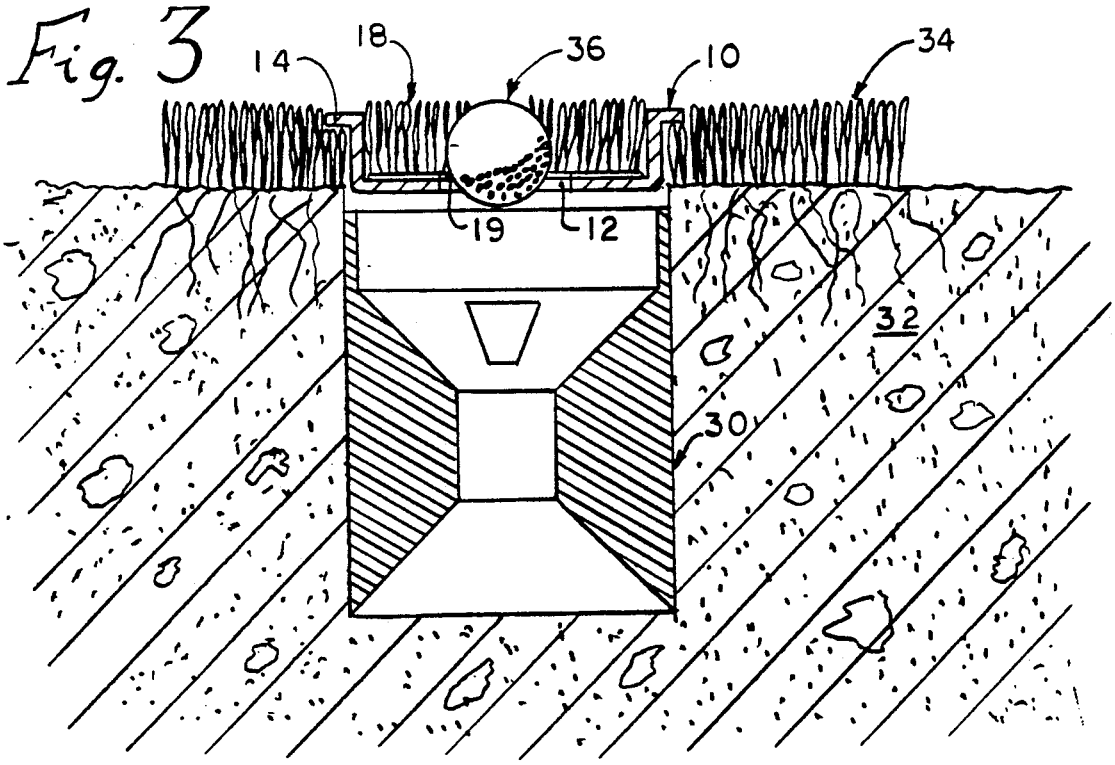
FIG. 3 illustrates a vertical sectional of a conventional golf putting cup with the device inserted.

Referring to FIG. 1 and FIG. 2 in greater detail, the device comprises a retainer 10 which contains a recessed area 16, a rim lip 14, which supports the entire assembly when placed in the putting hole, and a hole 12 for the golf ball to pass through. The recessed area is a cavity formed by a retainer base plate 13 and a cylindrical side wall 11. The carpet putting green 18, is glued to the base plate 13 in the retainer recessed area 16. The concentric inside hole 19 is designed to aligns with the hole 12 in the retainer 10. FIG. 3 illustrates how the retainer rim lip 14 makes contact with the putting green grass thereby maintaining the golf improvement device level to the adjacent grass plus keeping the retainer 10 from falling into the conventional golf course putting hole. The outside diameter of the retainer side walls 11 is slightly smaller compared to the conventional golf cup 30 thus preventing any damage to the conventional golf cup 30. Since the conventional golf cup 30 can be positioned at various depths, the rim lip 14 makes this device independent of the depth of the cup.

Operation of Invention

To operate the golf putting aid device, the golfer simply inserts the said device in the conventional golf course putting hole as illustrated in FIG. 3. The retainer rim lip 14 levels the device relative to the adjacent putting green grass making the installation very simple. The golfer positions himself/herself at any specify distance from the hole and putts several conventional golf balls into the center of the golf putting aid device. Being the golf putting aid device has a reduced hole, the golfer must concentrate on putting the golf ball into the hole. The golfer will improve his/hers skills on both the precise angular positioning of their putter as well as the correct amount of contact force he must apply to the golf ball to prevent the ball to over running the smaller hole of the device. Thereby this golf putting aid device illustrated in FIG. 1 will enhance ones golf game simply by improving the golfers skill and ability to putt the golf ball directly to the hole.

I claim:

1. A golf putting improvement device comprising:

a retainer member having a recessed area, a base plate, a cylindrical sidewall, and a circular extension lip on the upper edge of the sidewall, the said base plate having a concentric hole of greater diameter than the diameter of a conventional golf ball and having an outside diameter complementary to the inside diameter of the said cylindrical sidewall, the cylindrical sidewall outside diameter being slightly smaller than the inside diameter of a conventional golf putting hole and being of length to accommodate the height of a simulated grass media, the said circular extension lip of the said retainer upper edge having means to engage the adjacent surface surroundings of a conventional golf putting hole.

2. The device of claim 1 wherein a simulated grass media is positioned within the recessed area of the said retainer member, said simulated grass media having an outer diameter being complementary to the inside diameter of the cylindrical side wall of the retainer member and a concentric inner circular hole sized to be aligned with said concentric hole in said base plate to permit a conventional golf ball to pass through said aligned holes when said device is positioned above the putting cup in a conventional golf putting hole.

* * * * *